US010767407B2

(12) United States Patent
Salice

(10) Patent No.: US 10,767,407 B2
(45) Date of Patent: Sep. 8, 2020

(54) HINGE WITH ELASTIC OPENING MEANS FOR DOOR LEAVES OF FURNITURE

(71) Applicant: ARTURO SALICE S.P.A., Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 56 days.

(21) Appl. No.: 16/084,319

(22) PCT Filed: Mar. 17, 2017

(86) PCT No.: PCT/EP2017/056342
§ 371 (c)(1),
(2) Date: Sep. 12, 2018

(87) PCT Pub. No.: WO2017/158139
PCT Pub. Date: Sep. 21, 2017

(65) Prior Publication Data

US 2019/0071908 A1 Mar. 7, 2019

(30) Foreign Application Priority Data

Mar. 18, 2016 (IT) ..... 102016000028439

(51) Int. Cl.
*E05D 11/10* (2006.01)
*E05D 3/14* (2006.01)
(Continued)

(52) U.S. Cl.
CPC ..... *E05D 11/1021* (2013.01); *E05D 3/142* (2013.01); *E05D 7/0407* (2013.01);
(Continued)

(58) Field of Classification Search
CPC . E05D 11/1021; E05D 11/1064; E05D 3/142; E05D 7/0407; E05D 7/0415;
(Continued)

(56) References Cited

U.S. PATENT DOCUMENTS 2,039,130 A * 4/1936 Van Note ..... E05D 3/06 16/278
3,564,643 A * 2/1971 Salice ..... E05D 11/1021 16/278
(Continued)

FOREIGN PATENT DOCUMENTS

CN 101512088 A 8/2009
CN 102995998 A 3/2013
(Continued)

OTHER PUBLICATIONS

International Search Report and Written Opinion dated May 17, 2017 issued in PCT/EP2017/056342.
(Continued)

*Primary Examiner* — William L Miller
(74) *Attorney, Agent, or Firm* — Scully, Scott, Murphy & Presser, P.C.

(57) ABSTRACT

A hinge for door leaves of furniture and the like, which comprises a fixed part that can be connected to a body of a piece of furniture and a movable part that can be connected to a door leaf of the piece of furniture, the fixed part and the movable part being mutually connected in an oscillating manner by way of an articulation system that comprises at least one articulation axis and a rocker, the hinge comprising elastic means for opening the hinge which are functionally connected to the at least one rocker; the fixed part of the hinge is shaped so that it can be inserted into a seat defined within the thickness of an upper or lower wall of a piece of furniture.

11 Claims, 4 Drawing Sheets

(51) Int. Cl.
*E05D 7/04* (2006.01)
*E05F 1/12* (2006.01)

(52) U.S. Cl.
CPC ..... *E05D 7/0415* (2013.01); *E05D 7/0423* (2013.01); *E05D 11/1064* (2013.01); *E05F 1/1253* (2013.01); *E05Y 2600/41* (2013.01); *E05Y 2600/452* (2013.01); *E05Y 2900/20* (2013.01)

(58) Field of Classification Search
CPC ..... E05D 7/0423; E05F 1/1253; E05F 3/20; E05F 5/006; E05Y 2600/41; E05Y 2600/452; E05Y 2900/20; Y10T 16/53832; Y10T 16/547; Y10T 16/5476; Y10T 16/53864; Y10T 16/53253; Y10T 16/585; Y10T 16/593; Y10T 16/5995; Y10T 16/2771; Y10T 16/299; Y10T 16/304; Y10T 16/54029
USPC ..... 16/287, 366, 370, 302, 245, 80, 72, 76, 16/54, 65, 50, 335
See application file for complete search history.

(56) References Cited

U.S. PATENT DOCUMENTS 3,975,791 A * 8/1976 Hettich ..... E05F 5/006 16/294
4,083,082 A 4/1978 Holmes
4,349,941 A * 9/1982 Rock ..... E05D 11/1021 16/288
4,400,848 A * 8/1983 Grass ..... E05D 5/08 16/332
5,029,362 A * 7/1991 Prodan ..... E05D 11/1021 16/236
7,065,833 B2 * 6/2006 Kropf ..... E05D 3/142 16/286
8,627,547 B2 * 1/2014 Soh ..... E05D 11/0081 16/298
10,041,283 B2 * 8/2018 Zetti ..... E05F 3/20
10,221,597 B2 * 3/2019 Hammerer ..... E05D 3/16
10,407,963 B2 * 9/2019 Salice ..... E05D 7/0407
2013/0067686 A1 * 3/2013 Migliorini ..... E05D 11/1021 16/298

FOREIGN PATENT DOCUMENTS

DE 296 11 392 U1 10/1996
DE 100 47 978 A1 4/2002
DE 202006013360 U1 2/2008
EP 1477628 A1 11/2004
EP 2130996 A2 12/2009

OTHER PUBLICATIONS

Italian Search Report dated Nov. 4, 2016 issued in IT UA20161798, with partial translation.
Chinese Office Action dated Nov. 19, 2019 received in Chinese Patent Application No. 201780013026.1.

* cited by examiner

HINGE WITH ELASTIC OPENING MEANS FOR DOOR LEAVES OF FURNITURE

The present invention relates to a hinge with elastic opening means for door leaves of furniture or the like, in particular a hinge that has a fixed part or wing, shaped so that it can be inserted into a seat provided in the thickness of an upper or lower wall of the piece of furniture.

In the furniture sector, furniture is often used that has door leaves with no handles or similar grip means; in such case, the door leaves are conventionally connected in an oscillating manner to the body of the item of furniture by way of hinges provided with springs adapted to impose a movement on such door leaves in the direction of opening, at least in a neighborhood of the closed position of the door leaf.

Furthermore, adapted coupling devices are provided for releasably locking the door leaves in the closed position, and these devices, following a light push on the closed door leaf by the user, are released in order to permit the springs of the hinges to generate a movement of the door leaf in the direction of opening at least by a first amount sufficient for the user to grasp it and so open it completely.

In general the hinges used for such application comprise a fixed part that can be connected to an inner lateral surface of the body of the piece of furniture and a movable part, constituted by a box-like body, that can be connected to the leaf, such parts being mutually articulated in an oscillating manner by way of at least one rotation axis and more preferably by way of an articulation system that comprises a plurality of articulation axes and connecting rockers.

Furthermore, as mentioned, such hinges comprise a spring acting in the direction of opening, which conventionally, such as for example shown in EP 1 477 628, is in the form of a V-shaped laminar spring or a torsion spring which, by virtue of the fact that the rockers extend along planes that pass through the articulation axes, is contoured to act directly on one of the rockers.

However, the known solutions for such opening springs are not suitable for or cannot be applied to a different, completely invisible type of hinge, in which the fixed part or wing has a flat shape structure in order to be insertable in a seat provided in the thickness of the upper or lower wall of the piece of furniture, and in which the rockers extend along a plane perpendicular to the articulation axes, owing to the shape structure of the fixed part of the hinge and owing to the shape structure and arrangement of the rockers.

The aim of the present invention is to provide a hinge for door leaves of furniture or the like, of the type having a fixed part or wing shaped so that it can be inserted into a seat provided in the thickness of the upper or lower wall of the piece of furniture, that has elastic opening means with reduced encumbrance in order to be accommodated in the fixed part of such type of hinge, and that are configured to provide an effective elastic action to open the door leaves.

Within this aim, an object of the present invention is to provide a hinge for door leaves of furniture or the like, of the type mentioned above, in which the elastic opening means are configured simply and involve as few construction modifications as possible with respect to a corresponding version of the hinge with a spring that acts in the direction of closing.

Another object of the present invention is to provide a hinge for door leaves of furniture or the like that is highly reliable, easily and practically implemented and low cost.

This aim and these and other objects which will become better apparent hereinafter are achievable by a hinge for door leaves of furniture and the like, which comprises a fixed part that can be connected to a body of a piece of furniture and a movable part that can be connected to a door leaf of the piece of furniture, the fixed part and the movable part being mutually connected in an oscillating manner by way of an articulation system that comprises at least one articulation axis and a rocker, the hinge comprising elastic means for opening the hinge which are functionally connected to said at least one rocker, characterized in that said fixed part of the hinge is shaped so that it can be inserted into a seat defined within the thickness of an upper or lower wall of a piece of furniture, said fixed part and said at least one rocker extending along a plane that is perpendicular to said at least one articulation axis, and in that it comprises a movable element for transmission between said elastic opening means and said at least one rocker, said transmission element extending and being movable along said perpendicular plane and having a thrust surface that is shaped and arranged in order to act against a lateral contact surface of said rocker.

Further characteristics and advantages of the invention will become better apparent from the description of some preferred, but not exclusive, embodiments of the hinge according to the present invention, which are illustrated by way of non-limiting example in the accompanying drawings, wherein.

Figure 1:
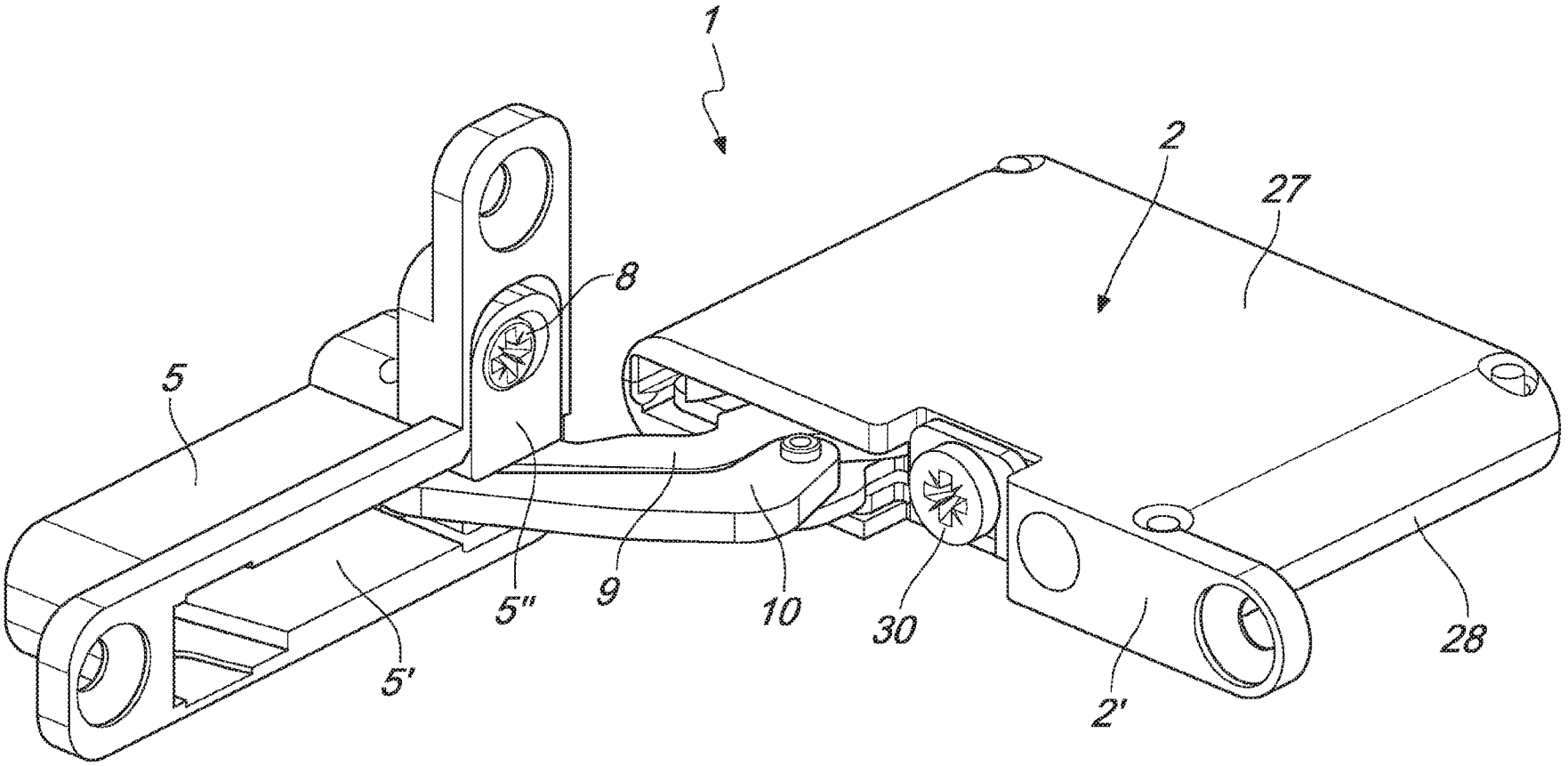
FIG. 1 is a perspective view of the hinge according to the invention.

With reference to the figures, a hinge according to the invention, which is generally designated with the reference numeral 1, comprises a fixed part or wing 2, which is shaped to be inserted into a seat 3 provided in the thickness of an upper or lower wall 4 of a piece of furniture and which opens on a front side of such walls, and a movable part 5 which is shaped to be inserted in a seat 6 defined in a door leaf 7 of the piece of furniture.

The hinge comprises at least one rocker and an articulation axis and more preferably a first rocker 9 and a second rocker 10 and four articulation axes 11, 12, 13, 14 that are adapted to define a quadrilateral articulation system and to allow the articulation of the movable part 5 with respect to the fixed part 2 of the hinge.

In order to be inserted into the seat 3 provided in the upper or lower wall 4 of the piece of furniture, the fixed part 2 of the hinge conveniently has a flat shape structure that extends along a plane perpendicular to the articulation axes 11-14 of the articulation system; in turn the rockers 9, 10 also have a flat shape structure and extend along a plane perpendicular to the articulation axes 11-14, so as to be accommodatable in the flat fixed part 2.

By virtue of such shape structure, the hinge is completely concealed and the only parts of the hinge that protrude from the seats 3 and 6 for insertion of the parts 2 and 5 of the hinge are the rockers 9 and 10, which are exposed to view when the door leaf of the piece of furniture is open.

The hinge likewise comprises elastic opening means that are functionally connected to one of the rockers 9, 10 of the articulation system.

According to the present invention, the hinge comprises a movable element for transmission between the elastic opening means and the rocker, such element extending and able to move along the aforementioned perpendicular plane; furthermore, the transmission element is provided with a thrust surface that is shaped and arranged in order to act against a lateral contact surface of the rocker 9 pressed by such elastic means, preferably at least in a neighborhood of the closed position of the hinge.

Figure 2:
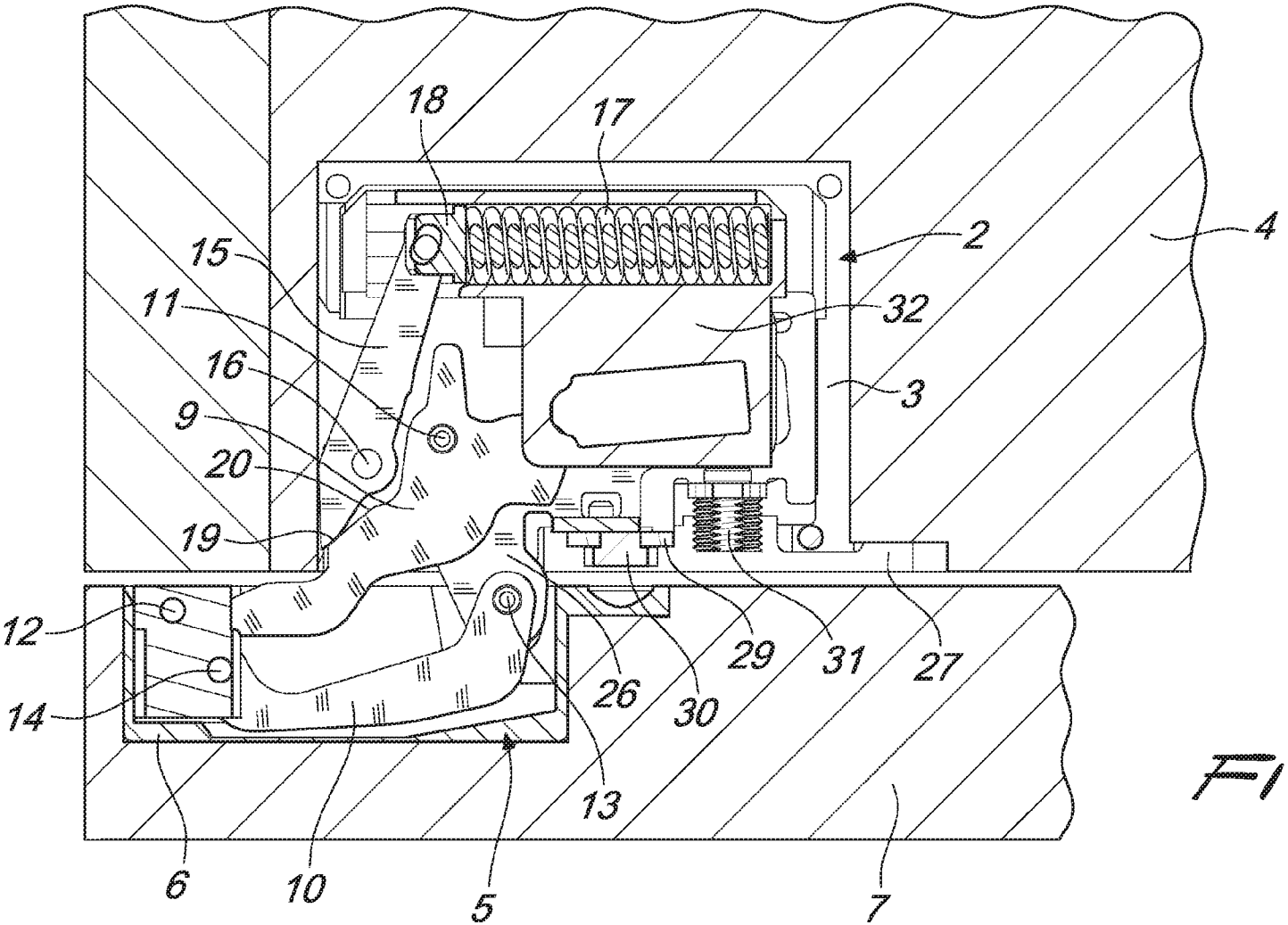
FIG. 2 is a cross-sectional view of a first embodiment of the hinge according to the invention, installed in a piece of furniture, with the door leaf in the closed condition.
Figure 3:
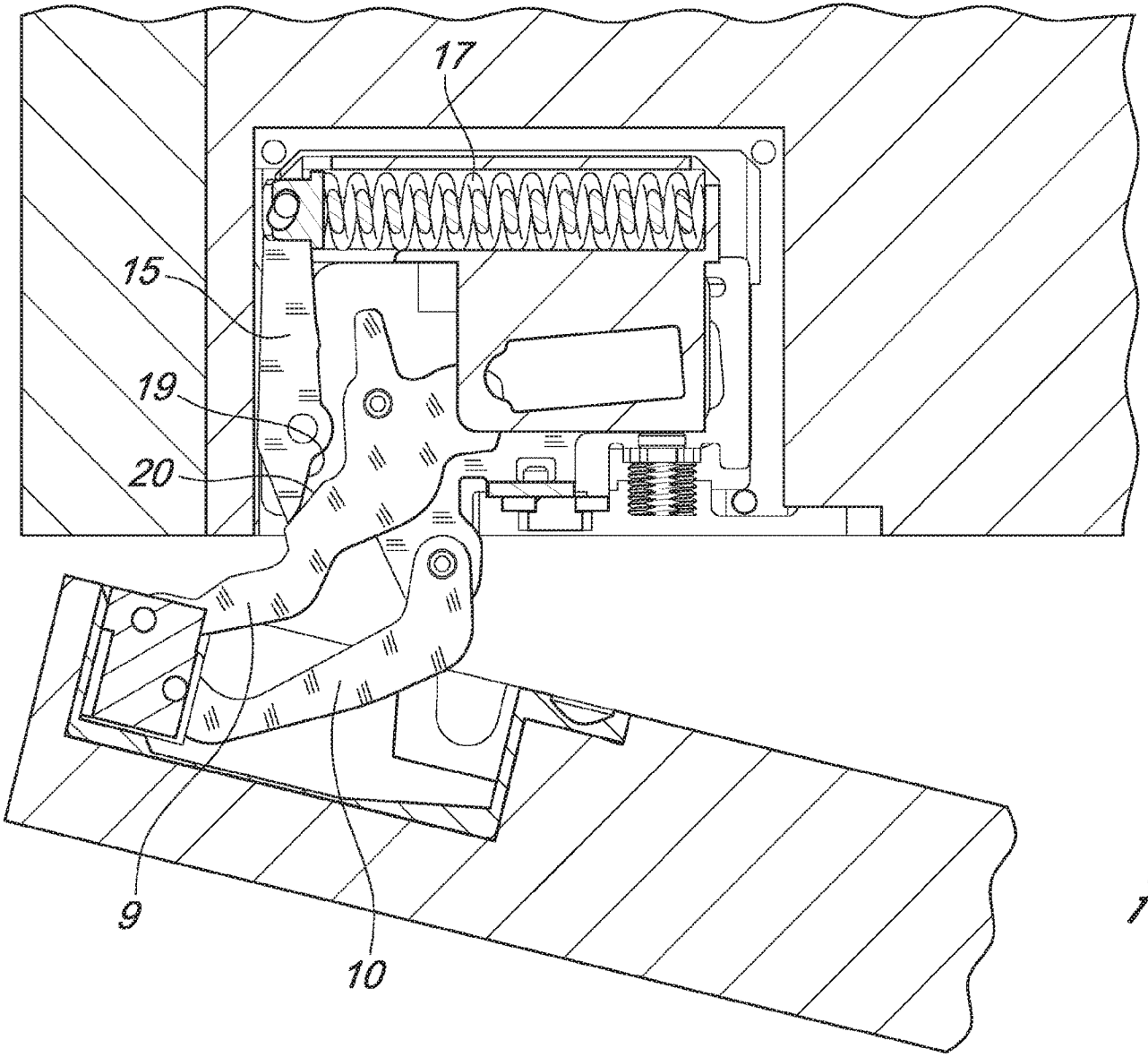
FIG. 3 is a cross-sectional view of the hinge of FIG. 2, with the door leaf in the partially open condition.

In particular, in the first embodiment illustrated in FIGS. 2 and 3, the transmission element is constituted by a lever 15 that is supported in an oscillating manner by the fixed part 2 of the hinge, preferably by way of an oscillation axis 16 arranged in an intermediate position along such lever, so as to be co-planar with the rockers 9, 10.

In this case, the elastic opening means are preferably in the form of a helical spring 17 arranged in a seat of the fixed part 2 so as to act on a first end of the lever 15, for example by way of a tappet 18 connected to such lever in an oscillating manner; at the opposite end of the lever 15 is the thrust surface 19, which extends parallel to the articulation axes 11-14 in order to act against the lateral contact surface 20 of the rocker 9 which also extends parallel to the articulation axes.

Preferably the thrust surface 19 and/or the contact surface 20 are cam-shaped so as to conveniently modulate the opening action imposed by the elastic means.

Preferably the oscillating lever 15 extends in a direction substantially perpendicular to the front surface 2' of the fixed part 2 of the hinge, while the accommodation seat for the spring 17 extends parallel to the front surface 2'; the possibility is not ruled out however for the oscillating lever 15 and the spring to be arranged differently.

Figure 4:
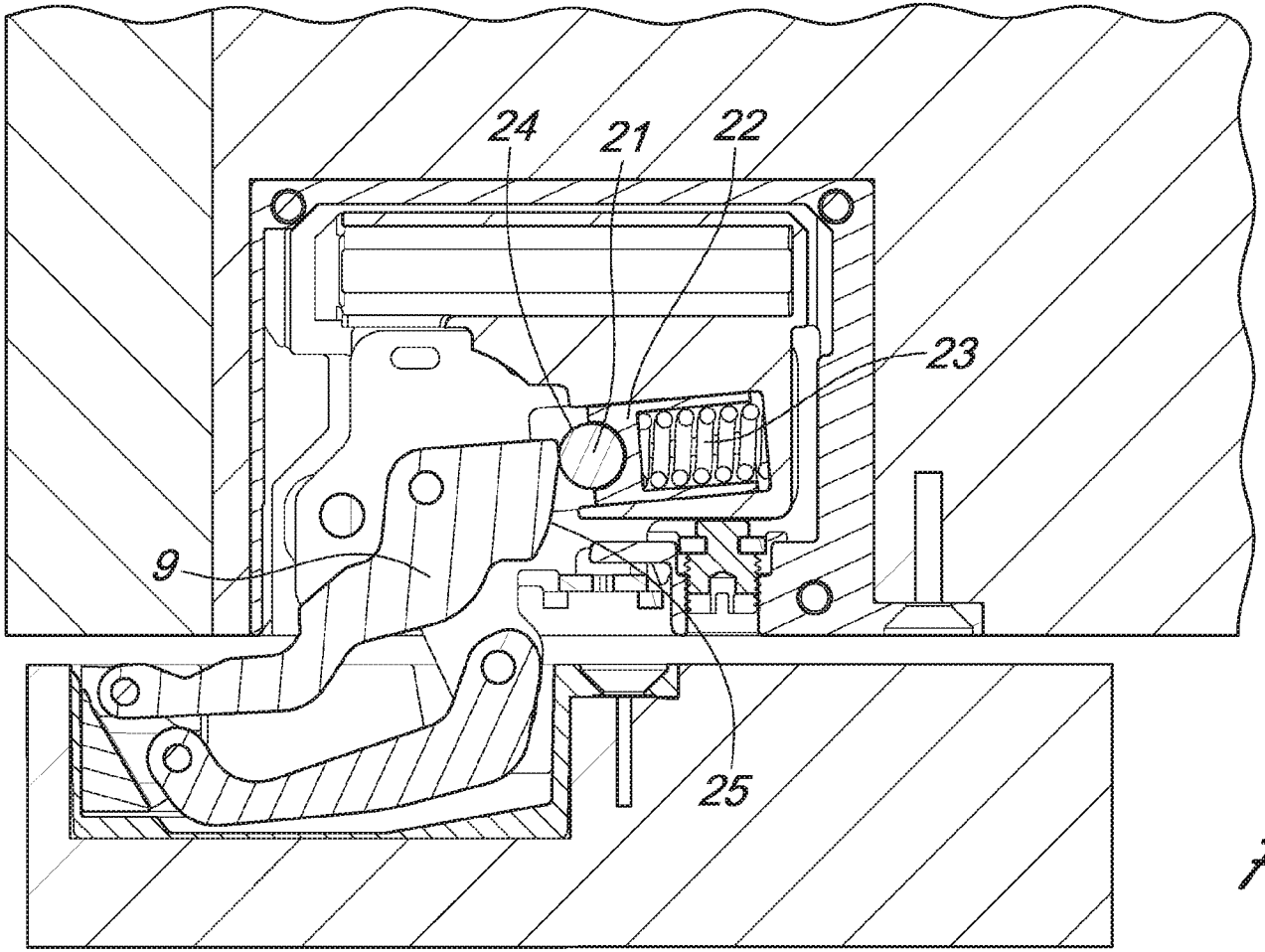
FIG. 4 is a cross-sectional view of a second embodiment of the hinge according to the present invention.

In the second embodiment, shown in FIG. 4, the transmission element is constituted by a roller 21 that is supported so that it can rotate by a movable element 22 that in turn is arranged so that it can slide in a seat of the fixed part 2 and is pressed by the elastic opening means, preferably in the form of a helical spring 23.

In particular the roller 21 extends on a plane perpendicular to the articulation axes 11-14 so as to be co-planar with the rocker 9 with which it comes into contact and it can rotate along an axis parallel to such articulation axes.

In such embodiment, the thrust surface according to the invention is constituted by the peripheral surface 24 of the roller 21, which acts on a lateral contact surface 25 of the rocker 9.

Preferably the contact surface 25 is cam-shaped so as to conveniently modulate the opening action imposed by the elastic means.

As an alternative to the helical springs, the elastic opening means can be constituted for example by torsion springs, laminar springs or springs of another type.

Preferably the hinge comprises adjustment means for adjusting the relative position between the fixed part 2 and the movable part 5 of the hinge in at least one among the lateral, front and vertical directions.

For example, in order to carry out the vertical adjustment of the hinge and therefore of the door leaf 7, preferably the movable part 5 comprises a first box-like part 5' that can be fixed to the leaf 7, a second part 5" that is connected to the first part 5' so that it can slide vertically, and an eccentric adjustment element 8 that makes it possible to define the relative position between the parts 5', 5".

In order to carry out the other adjustments, the rockers 9, 10, as well as the lever 15, are pivoted on a plate-like element 26 by way of the respective rotation axes 11, 13, 16, such element 26 also bearing a supporting body 32 in which the seat is defined for accommodating the elastic opening means 17, 23.

The plate-like element 26 and the supporting body 32 are supported so that they can move in a lateral direction by a second lower plate-like element 29 which in turn is accommodated so that it can move in a frontal direction in the fixed part 2, which preferably has a box-like body defined by an upper enclosure 27 and a lower enclosure 28.

In order to define the adjustment positions between the parts described above, there are frontal adjustment means 31, preferably of the screw type, to define the position of the plate-like element 29 with respect to the upper enclosure 27, and there are also lateral adjustment means 30, preferably of the cam screw type, so as to define the lateral position of the plate-like element 26 with respect to the plate-like element 29.

The adjustment means 8, 30, 31 conveniently comprise actuation means that can be maneuvered, for example in the form of screw head-type slots, and are accessible to the user from the frontal side of the piece of furniture within which the hinge is mounted, in order to allow an easy adjustment.

Further embodiments are also possible for the transmission of the elastic opening force from the elastic means to the rocker: it is for example possible to have a plurality of transmission elements between the elastic opening means and the rocker, in the form of a toggle linkage or other set of mutually articulated levers, or indeed another chain of kinematic transmission elements.

In practice it has been found that the hinge according to the present invention fully achieves the set aim and objects, since it is provided with elastic opening means and corresponding transmission means which have reduced encumbrance in order to be accommodated in the flat fixed part of the hinge of the type under consideration, and which are configured to provide an effective elastic action to open the door leaves.

Furthermore, the elastic opening means and the corresponding transmission means are configured simply and involve as few construction modifications as possible with respect to a corresponding version of the hinge with a spring that acts in the direction of closing.

The hinge, thus conceived, is susceptible of numerous modifications and variations, all of which are within the scope of the appended claims.

Moreover, all the details may be substituted by other, technically equivalent elements.

In practice the materials employed, as well as the contingent dimensions and shapes, may be any according to requirements and to the state of the art.

The disclosures in Italian Patent Application No. 102016000028439 (UA2016A001798) from which this application claims priority are incorporated herein by reference.

The invention claimed is:

1. A hinge for door leaves of furniture, which comprises a fixed part that can be connected to a body of a piece of furniture and a movable part that can be connected to a door leaf of the piece of furniture, the fixed part and the movable part being mutually connected in an oscillating manner by way of an articulation system that comprises at least one articulation axis and a rocker, the hinge comprising elastic means configured to open the hinge, which are functionally connected to said at least one rocker, wherein said fixed part of the hinge is shaped so that it can be inserted into a seat defined within the thickness of an upper or lower wall of the piece of furniture, said fixed part and said at least one rocker extending along a plane that is perpendicular to said at least one articulation axis, and further comprising a movable transmission element for transmission between said elastic opening means and said at least one rocker, said movable transmission element extending and being movable along said perpendicular plane and having a thrust surface that is shaped and arranged in order to act against a lateral contact surface of said rocker.

2. The hinge according to claim 1, wherein said thrust surface of the movable transmission element acts on said contact surface of the rocker at least in a neighborhood of the closed position of the hinge.

3. The hinge according to claim 1, wherein said thrust surface of the movable transmission element and said contact surface of the rocker extend parallel to said at least one articulation axis.

4. The hinge according to claim 1, wherein said movable transmission element is constituted by a lever that is supported in an oscillating manner by said fixed part of the hinge.

5. The hinge according to claim 4, wherein said lever is supported in an oscillating manner by way of an oscillation axis that is arranged in an intermediate position along said lever, said elastic means acting on a first end of the lever, said thrust surface being provided at an end that is opposite with respect to said first end.

6. The hinge according to claim 1, wherein said movable transmission element is constituted by a roller that is supported so that it can rotate by a sliding element pressed by said elastic means.

7. The hinge according to claim 1, wherein said thrust surface of the movable transmission element and/or said lateral contact surface of said rocker is cam-shaped.

8. The hinge according to claim 1, wherein said elastic means comprise a helical spring.

9. The hinge according to claim 1, wherein the articulation system between the fixed part and the movable part of the hinge comprises four articulation axes and two rockers, which extend along said plane at right angles to the articulation axes.

10. The hinge according to claim 1, further comprising adjustment means for adjusting the relative position between said fixed part and said movable part of the hinge in at least one among the lateral, front and vertical directions.

11. The hinge according to claim 10, wherein said seat for the fixed part of the hinge opens onto a front side of the body of the piece of furniture, said adjustment means of the hinge being provided with actuation means that can be accessed from the front side of the body of the piece of furniture, said actuation means being arranged at the front side of the piece of furniture where said seat for the fixed part of the hinge opens.

* * * * *